United States Patent [19]

Miyakawa

[11] Patent Number: 4,485,163

[45] Date of Patent: Nov. 27, 1984

[54] ONE-COMPONENT MAGNETIC DRY DEVELOPER COMPRISES TRIIRON TETROXIDE HAVING SPECIFIED COERCIVE FORCE AND VINYL AROMATIC POLYMER AND PROCESS OF USE

[75] Inventor: Nobuhiro Miyakawa, Suita, Japan

[73] Assignee: Mita Industrial Company Limited, Osaka, Japan

[21] Appl. No.: 384,232

[22] Filed: Jun. 2, 1982

Related U.S. Application Data

[62] Division of Ser. No. 220,098, Dec. 24, 1980, abandoned.

[30] Foreign Application Priority Data

Dec. 25, 1979 [JP] Japan ..... 54-167595

[51] Int. Cl.[3] ..... G03G 9/14

[52] U.S. Cl. ..... 430/122; 430/903; 148/105; 252/62.53

[58] Field of Search ..... 430/122, 903; 252/62.53

[56] References Cited

U.S. PATENT DOCUMENTS

| | | | |
|---|---|---|---|
| 3,510,338 | 5/1970 | Varron | 430/109 X |
| 3,577,345 | 5/1971 | Jacknow | 430/109 |
| 3,645,770 | 2/1972 | Flint | 430/122 |

*Primary Examiner*—John D. Welsh

*Attorney, Agent, or Firm*—Sherman & Shalloway

[57] ABSTRACT

A one-component magnetic dry developer for use in development of positively charged images and transfer of developed images, comprises particles of a composition comprising a vinyl aromatic polymer, an aliphatic carboxylic acid having at least 14 carbon atoms, inclusive of the carbon atom of the carboxyl group, per carboxyl group or its metal salt and a finely divided magnetic material having a coercive force not larger than 120 Oe and a bulk density of at least 0.45 g/ml.

This magnetic developer provides an excellent transferred image having high image density and image sharpness on a plain paper as a transfer sheet without fogging or broadening of the contour of the image.

5 Claims, 1 Drawing Figure

ONE-COMPONENT MAGNETIC DRY DEVELOPER COMPRISES TRIIRON TETROXIDE HAVING SPECIFIED COERCIVE FORCE AND VINYL AROMATIC POLYMER AND PROCESS OF USE

This is a division of application Ser. No. 220,098, filed Dec. 24, 1980, now abandoned.

BACKGROUND OF THE INVENTION (1) Field of the Invention

The present invention relates to a one-component dry magnetic developer suitable for obtaining a copied image or printed image by developing a positively charged image on a photosensitive plate and transferring the developed image on a plain paper as a transfer sheet.

(2) Description of the Prior Art

A so-called one-component magnetic developer comprising a finely divided magnetic material dispersed in developer particles is known and widely used as the developer capable of developing an electrostatic latent image without using a particular carrier.

As one type of the one-component magnetic developer, there is known a so-called conductive magnetic developer in which a finely divided magnetic material is incorporated in developer particles to impart a magnetically attractable property and a conducting agent such as conductive carbon black on the surfaces of the particles to impart an electric conductivity (see, for example, the specifications of U.S. Pat. Nos. 3,639,245 and 3,965,022). When this conductive magnetic developer is brought into contact in the form of a so-called magnetic brush with an electrostatic latent image-supporting plate to effect development of the latent image, there can be obtained an excellent visible image free of so-called edge effects or fogging. However, it is known that a serious problem arises when this developer image is transferred from the plate to an ordinary transfer sheet. More specifically, as disclosed in Japanese Patent Application Laid-Open Specification No. 117435/75, when the inherent electric resistance of a transfer sheet is lower than $10^{13}$ Ω-cm as in case of a plain paper, at the transfer step, broadening of the contour or reduction of the transfer efficiency is caused by scattering of developer particles. This disadvantage is removed to some extent if the toner-receiving surface of a transfer sheet is coated with a resin, wax or oil having a high electric resistance, but this improving effect is reduced under a high humidity condition. Furthermore, the cost of transfer sheets is increased by coating with a resin or the like and the touch or feel is reduced by the presence of such coating.

As another type of the one-component magnetic developer, there is known a one-component non-conductive magnetic developer comprising an intimate and homogeneous mixture of a finely divided magnetic material and an electricity-detecting binder. For example, the specification of U.S. Pat. No. 3,645,770 discloses an electrostatic photographic reproduction process in which a magnetic brush (layer) of the above-mentioned one-component non-conductive magnetic developer is charged by corona discharge with a polarity opposite to the polarity of an electrostatic latent image to be developed, and charged developer is brought into contact with an electrostatic latent image-supporting plate to develop the latent image and the developer image is transferred onto a transfer sheet. This electrostatic photographic reproduction process is advantageous in that a transfer image can be formed even on a plain paper as a transfer sheet. However, it is difficult to uniformly charge the magnetic brush of the non-conductive magnetic developer entirely even to the deep root portion, and therefore, it is difficult to obtain an image having a sufficiently high concentration. Furthermore, since a corona discharge mechanism should be disposed in the zone of a developing device, the copying apparatus becomes complicated.

Recently, there have been proposed a process in which development of an electrostatic latent image is accomplished by utilizing charging of a non-conductive magnetic developer by frictional contact of the developer with the surface of an electrostatic latent image-supporting plate (see Japanese Patent Application Laid-Open Specification No. 62638/75) and a process in which development is accomplished by utilizing dielectric polarization of a non-conductive magnetic developer (see Japanese Patent Application Laid-Open Specification No. 133026/76).

In the former process, however, developing conditions should be controlled strictly, and if the developing conditions are not strictly controlled, fogging in a non-image area (especially conspicuous when the degree of contact of the top end of a spike of magnetic toner particles with the surface of a photosensitive material is high) or fixation of blocking of magnetic toner particles on a developing sleeve is caused, and this defect is especially conspicuous when the copying operation is continuously conducted.

In the latter process, although a problem of fogging does not arise, since a visible image is formed by the developing charge produced by the dielectric polarizing effect induced in the magnetic toner to an electrostatic latent image, a low-potential portion of the latent image cannot effectively be developed. Accordingly, a low-density area of an original is not effectively reproduced in the obtained copy and reproduction of a half tone in the copy is very difficult.

Furthermore, copies obtained according to these two known processes are poor in the image sharpness, and when a p-type photosensitive material such as selenium is used for a photosensitive plate and a positively charged image is developed, it is difficult to obtain images having a sufficiently high density according to any of these two known processes.

BRIEF SUMMARY OF THE INVENTION

I found that if a finely divided magnetic material having specific coercive force and bulk density is selected and used as the magnetic material of the one-component magnetic developer and if these developer particles are prepared by dispersing this specific magnetic material into a binder medium comprising a vinyl aromatic polymer and an aliphatic carboxylic acid or a metal salt thereof, development of a positively charged image on a photosensitive plate and transfer of the developed image on a plain paper can be performed at a high developing efficiency and a high transfer efficiency without contamination of the background or broadening of the contour of the image and various defects of the conventional techniques can be eliminated effectively.

It is therefore a primary object of the present invention to provide a one-component magnetic developer which makes it possible to perform development of a positively charged image on a photosensitive plate and subsequent transfer of the developed image on a plain paper at high developing and transfer efficiencies without contamination of the background or broadening of the contour in the transferred image.

Another object of the present invention is to provide a one-component dry magnetic developer which makes it possible to perform development of an electrostatic charged image very easily without using a particular accessory device such as a corona discharge mechanism or excessive frictional contact of a magnetic brush of the developer with the surface of a photosensitive plate.

In accordance with the present invention, there is provided a one-component magnetic developer for use in development of a positively charged image and transfer of a developer image, which comprises particles of a composition comprising a vinyl aromatic polymer, an aliphatic carboxylic acid having at least 14 carbon atoms (total carbon atoms inclusive of the carbon atom of the carboxyl group) per carboxyl group or a metal salt of said aliphatic carboxylic acid, and a finely divided magnetic material having a coercive force not larger than 120 Oe and a bulk density of at least 0.45 g/ml.

BRIEF DESCRIPTION OF THE DRAWINGS

The FIGURE is a diagram illustrating a developing process using a one-component magnetic developer according to the present invention.

DETAILED DESCRIPTION OF THE PREFERRED EMBODIMENTS

Figure 1:
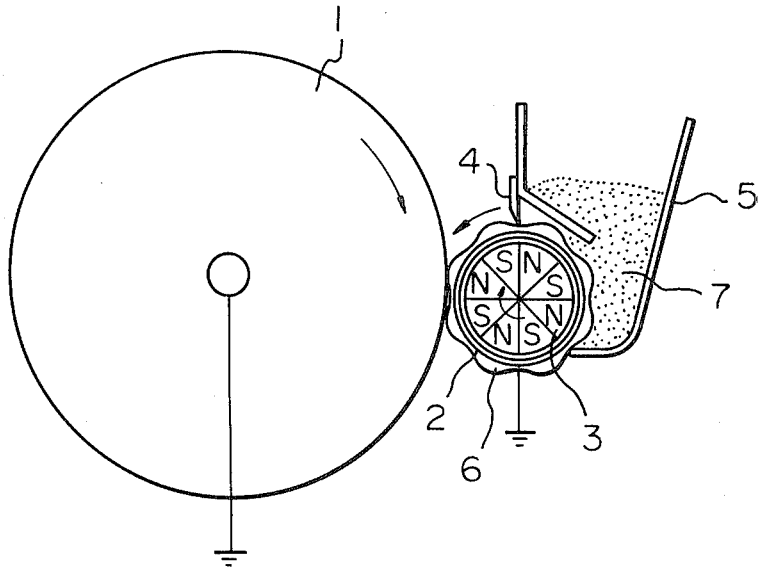

The present invention will now be described in detail.

Ordinarily, when a magnetic brush of a one-component type developer is brought into contact with an electrostatic latent image-supporting surface of a substrate, an electrostatic attracting force (Coulomb force) and a magnetic attracting force are produced between the developer particles and the electrostatic latent image and between the developer particles and a magnetic brush-forming magnet, respectively. Accordingly, developer particles on which the Coulomb force is larger are attracted to the electrostatic latent image and developer particles on which the magnetic attracting force is larger are attracted to a developing sleeve, whereby development is conducted according to the electrostatic latent image on the substrate. Accordingly, it is required that a certain balance should be maintained between the magnetic characteristic and charging characteristic at the developing step.

When a developer image is transferred onto a transfer sheet, corona discharge of a polarity opposite to the retained charges of the developer, that is, the same polarity as that of the electrostatic latent image on the photosensitive substrate (positive polarity), is performed from the back surface of the transfer sheet, whereby the developer image is attracted toward the transfer sheet. When the retained charges on the developer particles are readily extinguished or neutralized, the developer particles are scattered around or repelled toward the photosensitive plate, resulting in occurrence of broadening of the contour of the transferred image or reduction of the transfer efficiency. Accordingly, although this one-component magnetic developer contains a relatively large quantity of the finely divided magnetic material, it is required that the developer should have a property of retaining charges stably.

One important feature of the developer of the present invention is that a finely divided magnetic material having a coercive force not larger than 120 Oe and a bulk density of at least 0.45 g/ml is selected as the finely divided magnetic material and is combined with a medium comprising a vinyl aromatic polymer and an aliphatic carboxylic acid having at least 14 carbon atoms (inclusive of the carbon atom of the carboxyl group) per carboxyl group or a salt of said aliphatic carboxylic acid.

In the instant specification and appended claims, the bulk density is one determined according to the Method of K-5101 of JIS (Japanese Industrial Standard).

In the present invention, in order to increase the developing efficiency and transfer efficiency and improve the density of the transferred image, it is important that a finely divided magnetic material, especially finely divided triiron tetroxide (magnetite), having a coercive force (Hc) not higher than 120 Oe and a bulk density of at least 0.45 g/ml should be used. More specifically, as illustrated in Table 3 in Example 2 given hereinafter, when magnetite having a coercive force larger than 120 Oe is used, it is difficult to form a transferred image having a satisfactorily high density. Furthermore, even if the coercive force is not larger than 120 Oe, when the bulk density of magnetite is lower than 0.45 g/ml, it is similarly difficult to form a transferred image having a satisfactorily high density. In contrast, when finely divided magnetite in which the above two requirements are satisfied is used according to the present invention, it becomes possible to prominently improve the density of the transferred image, and the sharpness of the obtained image is remarkably improved over the density of an image formed by using magnetite not included in the scope of the present invention. Furthermore, if this finely divided magnetic material is used, the problem of scattering of the toner on the obtained copy can effectively be solved.

The reasons why such effects are attained in the present invention have not completely been elucidated, but it is believed that these effects will probably be attained by virtue of the following features. As pointed out hereinbefore, in a magnetic developer, the developing efficiency is influenced by a balance between the magnetic attracting force and Coulomb force simultaneously imposed on the developer particles. When a magnetic material having a coercive force exceeding the range specified in the present invention is used, the magnetic attracting force is increased, and therefore, reduction of the developing efficiency is caused. The bulk density of the magnetic material has close relations to the shape anisotropic characteristic and particle size in the magnetic material particles, and a finely divided magnetic material having a low bulk density tends to provide a magnetic developer having large electrostatic capacitance and dielectric constant. In contrast, if a magnetic material having a bulk density of at least 0.45 g/ml is used, the dielectric constant is controlled to a relatively low level, and therefore, charging of the respective developer particles is facilitated, and since also the electrostatic capacitance of the developer is controlled at a relatively low level, tendency of the charges to escape is reduced. It is believed that the developing efficiency and transfer efficiency will probably be increased for these reasons.

In the present invention, it also is important that a finely divided magnetic material having the above-mentioned characteristics should be dispersed in a medium comprising an aliphatic carboxylic acid having at least 14 carbon atoms (inclusive of the carbon atom of the carboxyl group) per carboxyl group or a salt thereof and a vinyl aromatic polymer. As illustrated in Example 3 given hereinafter, even if a magnetic material satisfying the requirements of the present invention is used, when it is dispersed in a medium free of the above-mentioned aliphatic carboxylic acid or its salt, it is difficult to increase the density of the transferred image to a satisfactorily high level, and the obtained copy is poor in the sharpness and contamination of the background is caused by scattering of the toner. This defect is similarly observed when an aliphatic carboxylic acid having less than 14 carbon atoms per carboxyl group or a dicarboxylic acid is employed as the carboxylic acid component. On the other hand, when a carboxylic acid having at least 14 carbon atoms, preferably at least 18 carbon atoms (inclusive of the carbon atom of the carboxyl group), or its salt is used according to the present invention, the density of the transferred image can remarkably be improved, and also the sharpness of the image can be enhanced and troubles owing to scattering of the toner can effectively be prevented.

The reasons why such effects can be attained by the use of the above-mentioned aliphatic carboxylic acid or its salt have not been elucidated completely. However, since the dielectric constant and electrostatic capacitance of the formed developer are controlled to relatively low levels if the above-mentioned aliphatic carboxylic acid or its salt is incorporated in a binder medium, it is believed that the developing efficiency and transfer efficiency will probably be increased for the same reasons as described above with reference to the finely divided magnetic material. Furthermore, it has been confirmed that the aliphatic carboxylic acid or its salt that is used as a part of the binder medium has a function to facilitate uniform dispersion of the magnetic material in the finely divided state and is effective for controlling charges of the developer particles to the negative side.

The finely divided magnetic material having the above-mentioned characteristics may easily be selected from triiron tetroxide (magnetite) of an isometric crystal system and slightly rounded amorphous triiron tetroxide. It must be noted that triiron tetroxide of a needle crystal system has a coercive force much larger than 120 Oe and such triiron tetroxide cannot be used in the present invention at all. In order to satisfy the above requirements, it is preferred that the particle size of the finely divided magnetic material be 0.3 to 1 micron, especially 0.35 to 0.7 micron. Furthermore, it is important that the finely divided magnetic material should be one that has not been subjected to a doping treatment with cobalt or the like. Moreover, it is preferred that the shape anistropic characteristic defined as the longest size/shortest size ratio be in the range of from 1.0 to 5.5, especially from 1 to 3.

Triiron trioxide having the above-mentioned characteristics may be prepared according to the following process, though the preparation process is not limited to the process described below. More specifically, an aqueous solution of sodium hydroxide is added to an aqueous solution of iron (III) sulfate to form a precipitate of iron (III) hydroxide. Then, the pH value of the mother liquor is adjusted to 4 to 11 and the hydrothermic treatment is carried out under pressure to convert a gel-like precipitate of iron hydroxide to cubic $\alpha$-$Fe_2O_3$ (hematite). Conditions for preparation of this cubic $\alpha$-diiron trioxide are described in detail, for example, in Nobuoka et al., Kogyo Kagaku Zasshi, 66, page 412 (1963). The hydrothermic treatment may be carried out at 150° to 230° C. for 10 to 100 hours. Ordinarily, as the pH value of the mother liquor is high, the particle size is large. Accordingly, $\alpha$-diiron trioxide having a desirable particle size can easily be obtained by adjusting the pH value of the mother liquor as well as the treatment temperature and time. The so-obtained $\alpha$-diiron trioxide is subjected to a reducing treatment under known conditions, for example, in a reducing furnace with hydrogen at 400° C., whereby triiron tetroxide of anisometric system or slightly rounded amorphous triiron tetroxide ($Fe_3O_4$) is obtained. The reducing treatment is ordinarily carried out so that the $Fe^{2+}/Fe^{3+}$ atomic ratio in the resulting triiron tetroxide is in the range of from 0.9 to 1.0 to 1.1 to 1.0, whereby triiron tetroxide having the above-mentioned characteristics can be obtained.

At the step of forming $\alpha$-diiron trioxide as the precursor, if the hydrothermic treatment is carried out under a relatively low pH value condition, there can be obtained triiron tetroxide in which corners of cubic crystals are rounded or amorphous triiron tetroxide having a slightly rounded shape. Such particles can be used in the present invention as well as particles of an isometric system.

As the aliphatic carboxylic acid having at least 14 carbon atoms (inclusive of the carbon atom of the carboxyl group) per carboxyl group, there can be mentioned saturated fatty acids such as myristic acid, pentadecylic acid, palmitic acid, heptadecylic acid, stearic acid, nonadecanoic acid, arachic acid, behenic acid, lignoceric acid, cerotic acid, heptacosanoic acid and montanic acid, unsaturated fatty acids such as oleic acid, elaidic acid, linoleic acid, cetoleic acid, erucic acid, brassidic acid, arachidonic acid and stearolic acid, and polymerized fatty acids (dimer acids). These acids may be used singly or in the form of a mixture of two or more of them. An aliphatic carboxylic acid having at least 18 carbon atoms (inclusive of the carbon atom of the carboxyl group) per carboxyl group is especially preferred. As preferred examples of the mixed fatty acid, there can be mentioned beef tallow fatty acid, coconut oil fatty acid and palm oil fatty acid.

As the metal salt of such fatty acid, there can be mentioned salts of alkaline earth metals such as calcium, magnesium and barium and polyvalent metals such as zinc, cadmium, aluminum, lead, cobalt, iron, nickel, chromium and manganese. In short, water-insoluble salts are preferred. Furthermore, lithium salts of such fatty acids can be used in the present invention.

In order to prevent blocking of the developer particles, it is preferred that the melting point of the aliphatic carboxylic acid or its metal salt be at least 45° C. Furthermore, in order to obtain a developer in which bleeding of the finely divided magnetic material from the binder medium is prevented and cohesion is effectively controlled during a long period storage, it is especially preferred that the fatty acid be used in the form of a metal soap.

In order to increase the density of the transferred image, it is important that a vinyl aromatic resin should be used as the binder resin. For example, there may be used homopolymers and copolymers of vinyl aromatic monomers, and copolymers of vinyl aromatic monomers with other mono- or di-ethylenically unsaturated monomers.

As the vinyl aromatic monomer, there are preferably used monomers represented by the following formula:

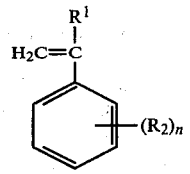

wherein $R_1$ stands for a hydrogen atom, a lower alkyl group having up to 4 carbon atoms or a halogen atom, $R_2$ stands for a substituent such as a lower alkyl group or a halogen atom, and n is an integer of 0, 1 or 2.

such as styrene, vinyltoluene, α-methylstyrene, α-chlorostyrene and vinylxylene, and vinylnaphthalenes. Among these monomers, sytrene and vinyltoluene are especially preferred.

As the monomer that is used in combination with such vinyl aromatic monomer, there can be mentioned, for example, acrylic monomers represented by the following formula:

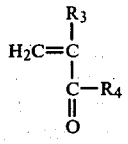

wherein $R_3$ stands for a hydrogen atom or a lower alkyl group, and $R_4$ stands for a hydroxyl group, an alkoxy group, a hydroxyalkoxy group, an aminoalkoxy group or an amino group, such as acrylic acid, methacrylic acid, ethyl acrylate, methyl methacrylate, butyl acrylate, butyl methacrylate, 2-ethylhexyl acrylate, 2-ethylhexyl methacrylate, 3-hydroxypropyl acrylate, 2-hydroxyethyl methacrylate, 3-aminopropyl acrylate, 3-N,N-diethylaminopropyl acrylate and acrylamide, conjugated diolefin monomers represented by the following formula:

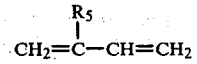

wherein $R_5$ stands for a hydrogen atom, a lower alkyl group or a chlorine atom, such as butadiene, isoprene and chloroprene, ethylenically unsaturated carboxylic acids and esters thereof such as maleic anhydride, fumaric acid, crotonic acid and itaconic acid, vinyl esters such as vinyl acetate, and vinylpyridine, vinylpyrrolidone, vinyl ethers, acrylonitrile, vinyl chloride and vinylidene chloride.

The intended objects of the present invention can be attained if the content of the vinyl aromatic monomer in the polymer is at least 25% by weight (in the instant specification, all of "%" and "parts" are by weight unless otherwise indicated). It is preferred that the molecular weight of the polymer be 3,000 to 300,000, especially 5,000 to 200,000.

In the present invention, it is preferred that the fatty acid or metal salt thereof be used in an amount of 0.2 to 4%, especially 0.5 to 3.5%, based on the finely divided magnetic material, and the vinyl aromatic polymer be used in an amount of 45 to 95%, especially 50 to 85%, based on the finely divided magnetic material. When the amount of the fatty acid or its metal salt is too small and below the lower limit of the above range, the developing efficiency or transfer efficiency is reduced and the density of the image is readily lowered. When the amount of the fatty acid or its salt is too large and exceeds the upper limit of the above range, fogging is readily caused in the obtained copy and blocking is often caused in the developer. Furthermore, if the amount of the vinyl aromatic polymer is too small and is below the lower limit of the above range, the electric characteristics and fixing property are readily reduced, and if the amount of the vinyl aromatic polymer is too large and exceeds the upper limit of the above range, the magnetic characteristics become unsatisfactory.

In the present invention, specific triiron tetroxide is incorporated and kneaded uniformly and homogeneously in a binder medium such as mentioned above, and the kneaded composition is pulverized to obtain a one-component dry magnetic developer.

Known adjuvants for developers may be added according to known recipes prior to kneading and pulverization in the present invention. For example, in order to improve the color tone of the developer, a pigment such as carbon black and a dye such as Acid Violet (C.I. 43525) may be used singly or in combination in an amount of 0.5 to 5% by weight based on the total amount of the developer. Furthermore, in order to attain an extending effect, a filler such as calcium carbonate or finely divided silicic acid may be added in an amount of up to 20% by weight based on the total amount of the developer. In case of a fixation method using a heating roll for fixation, an offset-preventing agent such as a silicone oil, a low-molecular-weight olefin resin or a wax may be added in an amount of 2 to 15% by weight based on the total amount of the developer, and in case of a fixation method using a pressure roll for fixation, a pressure fixing property-imparting agent such as a paraffin wax, an animal or vegetable wax or a fatty acid amide may be added in an amount of 5 to 30% by weight based on the total amount of the developer. Moreover, in order to prevent cohesion or agglomeration of developer particles and improve the flowability of the developer, a flowability-improving agent such as finely divided polytetrafluoroethylene may be incorporated in an amount of 0.1 to 1.5% by weight based on the total amount of the developer.

Shaping of the developer is accomplished by cooling the above-mentioned kneaded composition, pulverizing the cooled composition and, if necessary, classifying the pulverization product. Of course, mechanical rapid stirring may be carried out so as to round corners of amorphous particles.

It is ordinarily preferred that the particle size of the developer particles be 5 to 35μ, though the preferred particle size is changed to some extent according to the desired resolving power. By the use of the developer of the present invention comprising amorphous particles thus prepared by kneading and pulverization, it becomes possible to remarkably increase the transfer efficiency and obtain a sharp image having a high density.

In the electrostatic photographic reproduction process using the developer of the present invention, formation of an electrostatic latent image is accomplished according to known procedures. For example, there may be adopted a method in which a photoconductive layer on an electrically conductive substrate is uniformly charged and is then subjected to imagewise exposure to form an electrostatic latent image.

A magnetic brush of the above-mentioned one-component magnetic developer is brought into contact with the surface of the substrate carrying the electrostatic latent image formed thereon, whereby a visible image of the developer is formed.

Then, the developer image on the substrate is brought into contact with a transfer sheet, and corona discharge is performed with the same polarity as that of the electrostatic latent image from the back surface of the transfer sheet to transfer the developer image onto the transfer sheet.

Fixation of the transferred image is accomplished according to an optional fixation method selected according to the kind of the developer, for example, heating roller fixation, flash lamp fixation or pressure roller fixation.

The developer of the present invention is especially suitable for developing a positively charged latent image formed on a p-type photosensitive plate such as a selenium photosensitive plate or an organic photoconductor photosensitive plate.

A conventional friction-charge type one-component magnetic developer can be used for developing a negatively charged latent image formed on a photosensitive plate, but only unsatisfactory results are obtained when this conventional developer is used for developing a positively charged latent image on a p-type photosensitive plate such as mentioned above. In contrast, the developer of the present invention provides excellent results at the development of such positively charged images and transfer of the developed images to transfer sheets.

An embodiment of the above-mentioned developing process using the developer of the present invention is illustrated in the FIGURE, wherein reference numerals 1, 2, 3, 4, 5, 6 and 7 represent a selenium drum, a non-magnetic sleeve, a magnet, a spike cutting plate, a hopper, a brush layer of a magnetic developer, and the magnetic developer, respectively.

The present invention will now be described in detail with reference to the following Examples that by no means limit the scope of the invention. Incidentally, in these Examples, all of "parts" are by weight.

EXAMPLE 1

By using a two-roll kneading device, 275 parts of magnetite having a coercive force of 90 Oe, a bulk density of 0.95 g/ml and a particle size of 0.47 $\mu$, 210 parts of a styrene/acrylic monomer copolymer (supplied by Goodyear Co. and having a weight average molecular weight of 71,000), 2.5 parts of zince stearate and 17.5 parts of a high density polyethylene wax (200P supplied by Mitsui Petrochemical Co.) were kneaded together under fusion, and the kneaded mixture was naturally cooled and roughly pulverized by a cutting mill to adjust the size to 0.5 to 2 mm. Then, the roughly pulverized mixture was finely pulverized by a jet mill and classified by a zigzag classifier to obtain a magnetic toner having a size of 5 to 25$\mu$. Separately, a magnetic toner (comparative toner A) was prepared in the same manner as described above except that zinc stearate was not incorporated.

Incidentally, the coercive force (Hc) was measured by a magnetic property-measuring device supplied by Toyo Kogyo (Model; VSMP-1; magnetic field=5K Oe), and the bulk density was determined according to the Method K-5101 of JIS and the average particle size was determined from an electron microscope photograph.

The copying test was carried out in the following manner by using the above two magnetic toners.

In a copying machine provided with a selenium drum (having an outer diameter of 150 mm) as a photosensitive material, the magnetic toner was applied to a developing roller of a so-called independent rotation system where a magnet and a sleeve were independently rotated. The intensity of the magnetic field on a developing sleeve (having an outer diameter of 33 mm) having a magnet installed therein through a non-magnetic material was adjusted to about 900 gauss, and the space between the sleeve and a spike-cutting plate was adjusted to 0.3 mm. A hopper was arranged so that the magnetic toner was supplied from the hopper to the zone of the developing roller, and the space between the developing roller and the surface of the photosensitive material was adjusted to 0.5 mm. The developing sleeve and photosensitive material were rotated in the same direction, and the magnet was rotated in the opposite direction. Under these conditions, charging (+6.7 KV), imagewise exposure, development, transfer (+6.3 KV), heating roller fixation and fur brush cleaning were carried out. Wood free paper having a thickness of 80$\mu$ was used as the transfer sheet. The results of the copying test and the properties of the magnetic toner are shown in Table 1. The image density was expressed as the density of the solid black portion of the image measured by a commercially available reflection densitometer (supplied by Konishiroku Shashin Kogyo), and the electrostatic capacitance was determined by using a commercially available LC meter (supplied by Kokuyo Denki) and the electric resistance was measured by using a commercially available power source and ampere meter (supplied by Takeda-Riken). The cell used for determining the physical properties of the magnetic toners comprised an electrode portion comprised of stainless steel and an insulating portion comprised of quartz, in which the electrode spacing was 0.65 mm, the electrode sectional area was 1.43 $cm^2$ and the interelectrode load was 105 $g/cm^2$. The measurement was carried out at a temperature of 20° to 25° (room temperature) and a relative humidity of 55 to 65%. The sharpness of the image was evaluated based on the clarity of the line image portion of the obtained copy.

From the results shown in Table 1, it will readily be understood that by incorporation of zinc stearate, the image density was increased to a level about 1.5 times as high as the level attained without incorporation of zinc stearate, and therefore, a copy having a sharp and clear image could be obtained. It also is seen that both the electrostatic capacitance and dielectric constant were reduced by incorporation of zinc stearate.

TABLE 1

| Toner | Volume Resitivity (Ω-cm) | Electrostatic Capacitance (pF) | Dielectric Constant | Image Density | Sharpness (image quality) |
|---|---|---|---|---|---|
| toner of present invention | $3.2 \times 10^{14}$ | 7.4 | 3.79 | 1.41 | excellent |
| comparative toner | $3.1 \times 10^{14}$ | 7.8 | 4.00 | 0.95 | ordinary |

EXAMPLE 2

Magnetic toners were prepared in the same manner as described in Example 1 by using nine magnetites shown in Table 2, except that a vinyltoluene/acrylic monomer copolymer (supplied by Goodyear Co. and having a weight average molecular weight of 139,000) was used as the resin and calcium stearate was used as the fatty acid metal salt, and hydrophobic silica (R-972 supplied by Nippon Aerosil) was incorporated in an amount of 0.2% by weight based on the total amount of the toner after classification.

The copying test was carried out in the same manner as described in Example 1. The obtained results and properties of the magnetic toners are shown in Table 3.

In Table 2, magnetites (a), (b), (c) and (d) are those outside the scope of the present invention, and magnetites (e), (f), (g), (h) and (i) are those included in the scope of the present invention. In Table 3, magnetic toners (a), (b), (c) and (d) are comparative toners prepared by using the comparative magnetities (a), (b), (c) and (d), respectively, and magnetic toners (e), (f), (g), (h) and (i) are toners of the present invention prepared by using the magnetities (e), (f), (g), (h) and (i) of the present invention, respectively. Scattering of the toner was checked on the obtained copy.

In each magnetic toner, the volume resistivity was in the range of from $1\times10^{14}$ to $7\times10^{14}$ Ω-cm, and therefore, the values of the volume resistivity are not shown in Table 3.

From the results shown in Table 3, it is seen that even when calcium stearate was incorporated, if the magnetite used did not satisfy the requirements of the present invention, the image density was low and the obtained copy was poor in the sharpness with scattering of the toner.

TABLE 2

| Magnetite | Coercive Force (Oe) | Bulk Density (g/ml) | Particle Size (μ) |
|---|---|---|---|
| (a) | 85 | 0.37 | 0.3–0.4 |
| (b) | 98 | 0.40 | 0.3 |
| (c) | 135 | 0.71 | 0.1–0.2 |
| (d) | 213 | 0.55 | 0.4–0.5 |
| (e) | 41 | 0.53 | 0.5 |
| (f) | 49 | 0.47 | 0.4 |
| (g) | 56 | 0.71 | 0.5 |
| (g) | 90 | 0.95 | 0.47 |
| (i) | 114 | 0.45 | 0.35–0.4 |

TABLE 3

| Magnetic Toner | Electrostatic Capacitance (pF) | Dielectric Constant | Image Density | Scattering of Toner | Sharpness (image quality) |
|---|---|---|---|---|---|
| (a) | 8.0 | 4.10 | 1.11 | slight | ordinary |
| (b) | 8.0 | 4.10 | 1.10 | slight | ordinary |
| (c) | 7.9 | 4.05 | 1.02 | slight | ordinary |
| (d) | 7.7 | 3.95 | 1.10 | considerable | ordinary |
| (e) | 7.8 | 4.00 | 1.46 | not | good |
| (f) | 7.7 | 3.95 | 1.43 | not | good |
| (g) | 7.9 | 4.05 | 1.47 | not | good |
| (h) | 7.4 | 3.79 | 1.47 | not | excellent |
| (i) | 7.5 | 3.85 | 1.44 | not | good |

EXAMPLE 3

By using a two-roll kneading device, 385 parts of the same magnetite as used in Example 1, 290 parts of a vinyl-toluene/butadiene copolymer (supplied by Goodyear Co. and having a weight average molecular weight of 78,000), 24.5 parts of low-molecular-weight polypropylene (550P supplied by Sanyo Chemical Co.) and 3.5 parts of the long-chain carboxylic acid or its metal salt shown in Table 4 were kneaded under fusion, and the kneaded mixture was naturally cooled, roughly pulverized, finely pulverized and classified according to customary procedures. Then, hydrophobic silica was incorporated so as to improve the flowability.

The copying test was carried out in the same manner as described in Example 1. The obtained results are shown in Table 4. In each magnetic toner, the volume resistivity was in the range of from $1\times10^{14}$ to $7\times10^{44}$ Ω-cm, the electrostatic capacitance was in the range of from 7.2 to 8 and the dielectric constant was in the range of from 3.69 to 4.10. Accordingly, data of these properties are not shown in Table 4.

From the results shown in Table 4, it is seen that the intended effects could not be obtained when lauric acid (total carbon number=12) or a dicarboxylic acid was used as the long-chain carboxylic acid or its salt, and that when a magnetic toner comprising a long-chain fatty acid having a total carbon number of at least 14 or its metal salt was used according to the present invention, a copy having a sharp image having a high density could be obtained without scattering of the toner.

When magnesium, lead, chromium, copper, iron and nickel salts of stearic acid were similarly used as the fatty acid metal salt, copies being excellent in the image quality and having a high image density could similarly be obtained.

TABLE 4

| Long-Chain Carboxylic Acid or Its Metal Salt | | | | |
|---|---|---|---|---|
| Kind | Total Carbon Number (inclusive carbon of carboxyl group) | Image Density | Scattering of Toner | Sharpness (image quality |
| not incorporated | | 0.95 | slight | ordinary |
| lauric acid | 12 | 0.55 | slight | ordinary |
| myristic acid | 14 | 1.28 | not | good |
| palmitic acid | 16 | 1.35 | not | excellent |
| stearic acid | 18 | 1.47 | not | excellent |
| behenic acid | 22 | 1.48 | not | excellent |
| lithium stearate | 18 | 1.47 | not | excellent |
| aluminum monostearate | 18 | 1.47 | not | excellent |
| manganese oleate | | 1.49 | not | excellent |
| cobalt linoleate | | 1.47 | not | excellent |
| 1,10-decane-dicarboxylic acid | | 0.73 | slight | ordinary |

TABLE 4-continued

| Long-Chain Carboxylic Acid or Its Metal Salt | | | | |
|---|---|---|---|---|
| Kind | Total Carbon Number (inclusive carbon of carboxyl group) | Image Density | Scattering of Toner | Sharpness (image quality |
| 1,18-octadecane-dicarboxylic acid | | 0.95 | not | ordinary |

EXAMPLE 4

A magnetic toner was prepared in the same manner as described in Example 1 except that the magnetite (i) used in Example 2 was used instead of the magnetite used in Example 1. The composition of the respective ingredients are shown in Table 5.

The copying test was carried out in the same manner as described in Example 1. The obtained results are shown in Table 6.

From the results shown in Table 6, it is seen that though the image density and sharpness of the obtained copy were improved by incorporation of zinc stearate, fogging was caused with increase of the amount incorporated of zinc stearate and that the optimum amount of zinc stearate was 0.2 to 0.4% by weight based on the magnetite.

TABLE 5

| | Composition (parts by weight) | | | |
|---|---|---|---|---|
| Toner No. | magnetite (i) | Styrene/ acrylic monomer copolymer | high density polyethylene wax | zinc stearate |
| 1 | 55 | 41.5 | 3.5 | 0 |
| 2 | 55 | 41.5 | 3.5 | 0.15 |
| 3 | 55 | 41.5 | 3.5 | 0.5 |
| 4 | 55 | 41.5 | 3.5 | 1.0 |
| 5 | 55 | 41.5 | 3.5 | 2 |
| 6 | 55 | 41.5 | 3.5 | 2.5 |

TABLE 6

| Toner No. | Image Density | Background Density (fogging) | Scattering of Toner | Sharpness (image quality) |
|---|---|---|---|---|
| 1 | 0.75 | 0.11 | slight | ordinary |
| 2 | 1.20 | 0.11 | not | fair |
| 3 | 1.45 | 0.11 | not | good |
| 4 | 1.40 | 0.12 | not | good |
| 5 | 1.40 | 0.14 | not | fair |
| 6 | 1.37 | 0.17 | not | ordinary |

EXAMPLE 5

Magnetic toners were prepared in the same manner as described in Example 1 except that the magnetite (g) used in Example 2 was used instead of the magnetite used in Example 1. The composition of the respective ingredients are shown in Table 7.

The copying test was carried out in the same manner as described in Example 1. The obtained results are shown in Table 8.

From the results shown in Table 8, it is seen that if the magnetite content was 45% by weight, slight fogging was caused and the flowability was soemwhat reduced, and that if the magnetite content was 65% by weight, reduction of the image density was caused. Thus, it was confirmed that a preferred amount of magnetite is 50 to 60% by weight based on the amount of the toner.

When polystyrene (D-125 supplied by Esso Standard Chemical and having an average molecular weight of 3,000) was used as the resin, similar results were obtained. However, when an acrylic resin, a polyester resin and an epoxy resin were used, the image density was lower than 0.5, and in each case, a developer applicable to practical use could not be obtained.

When 10000 copies were formed in a continuous manner by using toner No. 9 shown in Table 8, it was found that increase of fogging was not observed and the image density was in the range of 1.42 to 1.47 throughout the copying operation.

TABLE 7

| | Composition (parts by weight) | | | |
|---|---|---|---|---|
| Toner No. | magnetite (g) | styrene/acrylic monomer copolymer | high density polyethylene wax | zinc stearate |
| 7 | 45 | 46.5 | 8 | 0.5 |
| 8 | 50 | 41.5 | 8 | 0.5 |
| 9 | 55 | 36.5 | 8 | 0.5 |
| 10 | 60 | 31.5 | 8 | 0.5 |
| 11 | 65 | 26.5 | 8 | 0.5 |

TABLE 8

| Toner No. | Content (% by weight) of Magnetite | Image Density | Background Density (fogging) | Sharpness (image quality) |
|---|---|---|---|---|
| 7 | 45 | 1.47 | 0.13 | fair |
| 8 | 50 | 1.45 | 0.12 | good |
| 9 | 55 | 1.46 | 0.11 | good |
| 10 | 60 | 1.37 | 0.11 | good |
| 11 | 65 | 1.20 | 0.11 | fair |

What is claimed is:

1. An electrostatic photographic reproduction process which comprises contacting a selenium photoconductive substrate carrying a positively charged electrostatic image with a magnetic brush of a one-component magnetic dry developer to effect development of the latent image and electrostatically transfer the formed image of the developer onto a transfer sheet, wherein the one-component magnetic dry developer consists essentially of particles of a composition comprising (A) a finely divided magnetic material composed of triiron tetroxide having a coercive force not larger than 120 Oe, a bulk density of at least 0.45 g/ml and a shape anisotropic characteristic, as defined as the longest size/shortest size ratio, in the range of from 1.0 to 5.5, (B) 0.2 to 4% by weight, based on the amount of the finely divided magnetic material, of an aliphatic carboxylic acid having at least 14 carbon atoms, inclusive of the carbon atom of the carboxyl group, per carboxyl group or a metal salt thereof, and (C) 45 to 95% by weight, based on the amount of the finely divided magnetic material, of a vinyl aromatic polymer containing at least 25% by weight of a vinyl aromatic monomer component.

2. A process according to claim 1, wherein the finely divided magnetic material is triiron tetroxide of an isometric system or rounded amorphous triiron tetroxide having a particle size of 0.3 to 1 micron.

3. A process according to claim 1, wherein the aliphatic carboxylic acid or its salt has a melting point of at least 45° C.

4. A process according to claim 1, wherein the metal salt of the aliphatic carboxylic acid is a water-insoluble polyvalent metal salt.

5. A method for developing and transferring a positively charged electrostatic latent image carried on a selenium photoconductive substrate which comprises contacting the latent image with a magnetic brush of a friction-chargeable one-component magnetic dry developer consisting essentially of particles of a composition comprising (A) from about 50 to 60% by weight, based on the total weight of the composition, of a finely divided magnetic material composed of triiron tetroxide of an isometric system or rounded amorphous triiron tetroxide having a particle size of 0.3 to 1 micron, a shape anisotropic characteristic, as defined as the longest size/shortest size ratio, in the range of from 1.0 to 5.5, a coercive force not larger than 120 Oe, and a bulk density of at least 0.45 g/ml, (B) 0.2 to 0.4% by weight, based on the amount of the finely divided magnetic material (A), of an aliphatic monocarboxylic acid having at least 18 carbon atoms, inclusive of the carbon atom of the carboxyl group, per carboxyl group, or a metal salt thereof and (C) 45 to 95% by weight, based on the amount of the finely divided magnetic material (A) of a vinyl aromatic polymer containing at least 25% by weight of a vinyl aromatic monomer component represented by the following formula:

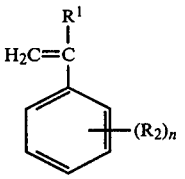

wherein $R_1$ stands for a hydrogen atom, a lower alkyl group having up to 4 carbon atoms or a halogen atom, $R_2$ stands for a substituent such as a lower alkyl group or a halogen atom, and n is an integer or 0, 1 or 2, wherein the developer particles become stably negatively charged by frictional contact without subjecting the magnetic brush to a corona discharge, whereby the latent image is developed by the developed particles, and electrostatically transferring the developed latent image onto a plain paper transfer sheet whereby a transferred image having high image density and image sharpness without fogging or broadening of the contour of the image is obtained.

* * * * *